US005779466A

United States Patent [19]

Okamura

[11] Patent Number: 5,779,466

[45] Date of Patent: Jul. 14, 1998

[54] GAS FLOW CONTROLLER

[75] Inventor: Chuichi Okamura, Osaka, Japan

[73] Assignee: Daishin Industrial Co., Ltd., Osaka, Japan

[21] Appl. No.: 524,444

[22] Filed: Sep. 6, 1995

[30] Foreign Application Priority Data

Mar. 8, 1995 [JP] Japan ..... 7-048687

[51] Int. Cl.[6] ..... F23N 5/24

[52] U.S. Cl. ..... 431/89; 431/12; 431/59; 431/76; 137/88

[58] Field of Search ..... 431/12, 90, 59, 431/76, 89; 137/487.5, 486, 101.9, 100, 487, 9, 88; 126/39 G, 39 E

[56] References Cited

U.S. PATENT DOCUMENTS 4,605,034 8/1986 Urushida ..... 137/88

4,838,295 6/1989 Smith et al. ..... 137/9

*Primary Examiner*—Larry Jones

*Attorney, Agent, or Firm*—Wenderoth, Lind & Ponack

[57] ABSTRACT

A gas flow rate controller arranged between a gas burner and a flammable gas source and a combustion-assisting gas source includes a gas flow rate setting means for producing a flow rate setting signal corresponding to a preset flow rate of gas flowing toward the gas burner. A ratio setting means produces a flammable gas setting reference signal and a combustion-assisting gas flow rate setting signal at a predetermined ratio, based on the flow rate setting signal produced by the gas flow rate setting means. The flow rate of the flammable gas detected is compared with the flammable gas setting reference signal produced and the flow rate of the combustion-assisting gas detected is compared with the combustion-assisting gas flow rate setting reference signal produced. Control valves are feedback controlled so that any differences therebetween will become zero. Thus the mixing ratio between the gases is kept constant even if the gas pressures change.

23 Claims, 7 Drawing Sheets

GAS FLOW CONTROLLER

BACKGROUND OF THE INVENTION

This invention relates to a gas flow controller for controlling the flow rate of gas to a gas burner for use in brazing, welding and glass working. More particularly, this invention relates to a controller capable of maintaining a predetermined flow rate and mixture rate of gas being supplied to the gas burner, irrespective of the primary gas supply pressure.

Gas brazing is one of the known methods of joining metal members together with a "brazing filler", i.e. a metal or alloy having a lower melting point than the metals to be joined together.

For such gas brazing, as shown in FIG. 8, a primary gas supply source 2 such as a factory piping is connected to a burner 1 for brazing through a gas box 3 for adjusting the flame strength produced from the burner 1 and the gas mixing ratio. From the gas supply source 2, a flammable gas such as LP gas, natural gas or acetylene gas, and a combustion-assisting gas such as oxygen or air are supplied to the brazing burner 1 to heat the articles to be joined together.

The gas box 3 includes a flammable gas circuit 5 and a combustion-assisting gas circuit 6 each comprising a regulator for adjusting the gas pressure, a flowmeter for measuring the flow rate, and a gas valve 4 for adjusting the gas flow rate. Each of the gas circuits 5 and 6 further includes a bypass circuit comprising solenoid valves 7 and a gas valve 4. By adjusting the flow rate of gas flowing through the bypass circuits with their respective gas valves 4 and changing over the solenoid valves 7 with a sequencer (not shown), weak flames and strong flames can be selectively produced from the burner 1.

In FIG. 8, numeral 8 designates a vapor tank for supplying a flux. The gas circuit designated 9 is a fire-extinguishing circuit adapted to discharge a non-combustible gas to prevent a backfire when extinguishing a fire.

One problem with this gas box 3 is that if the primary gas pressure changes, (due to change in the external temperature, the total amount of gas used, or the amount of gas remaining), the flow rates of the inflammable gas supplied through the gas circuit 5 and the combustion-assisting gas supplied through the gas circuit 6 change. This change in flow rates tends to cause the mixing ratio tends to deviate from the optimum value. This will result in an increased defective rate of the brazed articles.

Thus, an operator had to adjust the flame power by controlling the valves 4 every time the gas flow rate changed.

Such adjustment has to be carried out while consulting flowmeters, which are in most cases float type variable area flowmeters. Due to their measuring principle, if the actual pressure does not coincide with the design value, it is necessary to correct the flow rate displayed on the flowmeter. Thus, when adjusting flame power using such a flowmeter, the value displayed on the flowmeter has to be adjusted according to fluctuations in the primary gas pressure. Such adjustment is extremely troublesome. Moreover, an operator has to adjust the gas valve while watching the flames of the burner, so that he cannot afford to see the flowmeter. Since he cannot see the flowmeter, he has to depend on his past experience and sixth sense to adjust the flame power.

But the number of experienced and skilled operators who have such a sixth sense is decreasing these days due to the aging of these operators and a decreasing number of young people who are willing to learn these skills.

An object of this invention is to provide a gas flow controller which makes it possible to control the gas flow rate without depending upon experienced and skilled operators.

SUMMARY OF THE INVENTION

According to this invention, there is provided a gas flow rate controller arranged between a gas burner and a flammable gas source and a combustion-assisting gas sources. The controller of the present invention comprises a gas flow rate setting means for producing a flow rate setting signal corresponding to. The present controller also comprises a preset flow rate of gas flowing toward the gas burner, a ratio setting means for producing both a flammable gas setting reference signal and a combustion-assisting gas flow rate setting signal at a predetermined ratio based on the flow rate setting signal produced by the gas flow rate setting means. A first flow rate detecting means detects the flow rate of a flammable gas flowing toward the gas burner, and a second flow rate detecting means detects the flow rate of a combustion-assisting gas flowing toward the gas burner. A first comparison means compares the flow rate of the flammable gas detected by the first flow rate detecting means with the flammable gas setting reference signal produced by the ratio setting means and produces a control signal for eliminating any difference therebetween. Likewise, a second comparison means compares the flow rate of the combustion-assisting gas detected by the second flow rate detecting means with the combustion-assisting gas flow rate setting reference signal produced by the ratio setting means and produces a control signal for eliminating any difference therebetween. The flow rate of the flammable gas toward the gas burner is controlled by a first control value based on the control signal produced by the first comparison means. Correspondingly a second control valve controls the flow rate of the combustion-assisting gas toward the gas burner based on the control signal produced by the second comparison means.

By setting the flow rate of gas to be supplied to the gas burner with the gas flow rate setting means, the flow rate setting signal corresponding to this flow rate is outputted to the ratio setting means. Based on the flow rate setting signal, the ratio setting means produces a flammable gas flow rate setting signal and a combustion-assisting gas flow rate setting signal at a predetermined ratio. The flammable gas flow rate setting signal is outputted to the first comparison means, whereas the combustion-assisting gas flow rate setting signal is outputted to the second comparison means. In the ratio setting means, the mixing ratio of these gases is set at such a value that the combustion efficiency will be the highest. Since these setting signals are produced based on the gas flow rate set in the gas flow rate setting means, the gas mixing ratio never changes even if the gas flow rate changes. Thus, it is possible to change flame power simply by changing the gas flow rate.

On the other hand, the first comparison means receives the flammable gas flow rate setting signal, compares this setting signal with the actual flow rate of the flammable gas, which is detected by the first flow rate detecting means, and outputs a control signal to the first control valve to eliminate any difference therebetween. Namely, if e.g. the degree of opening of the control valve is adapted to change based on the control signal, the flow rate of the flammable gas toward the gas burner will change according to the degree of opening of the control valve. Such change in the flow rate is detected by the first detecting means. At the same time, the first comparison means compares this flow rate with the flammable gas flow rate setting signal, and applies a control signal for eliminating any difference therebetween to the first control valve. Any change in the flow rate due to the activation of the control valve is detected by the first detector. The first comparison means again compares the thus changed flow rate with the flammable gas setting signal, and applies a control signal for eliminating the difference therebetween to the control valve. This operation is repeated. Namely, a feedback loop that uses the flammable gas flow rate setting signal as its reference is formed in the circuit. This loop makes it possible to feed a flammable gas to the gas burner at a predetermined flow rate determined by the ratio setting means no matter how the gas pressure changes.

Similarly, the second comparison means compares the actual flow rate of the combustion-assisting gas with its setting signal and applies a control signal for eliminating the difference therebetween to the second control valve. Any change in the flow rate due to the activation of the control valve is detected by the second detector. The second comparison means again compares the thus changed flow rate with the setting signal, and applies a control signal for eliminating the difference therebetween to the control valve. This operation is repeated. Namely, a feedback loop that uses the combustion assisting gas flow rate setting signal as its reference is formed in the circuit. This loop makes it possible to feed a combustion-assisting gas to the gas burner at a predetermined flow rate determined by the ratio setting means no matter how the gas pressure changes.

Other features and objects of the present invention will become apparent from the following description made with reference to the accompanying drawings, in which:

DETAILED DESCRIPTION OF THE PREFERRED EMBODIMENT

Embodiments of the invention are now described with reference to the drawings.

Figure 1:
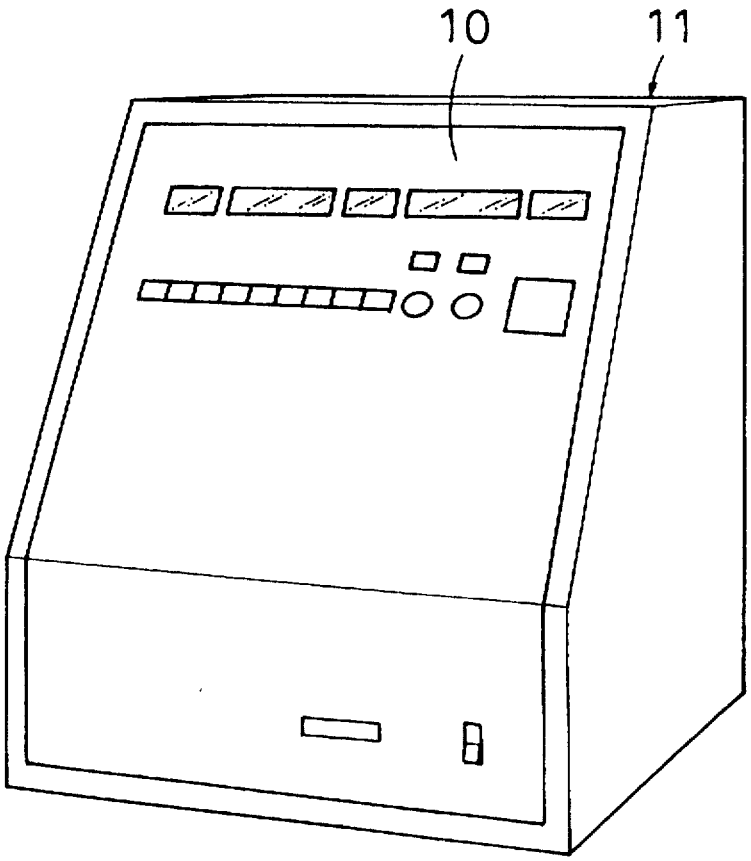
FIG. 1 is a perspective view of the invention.
Figure 2A:
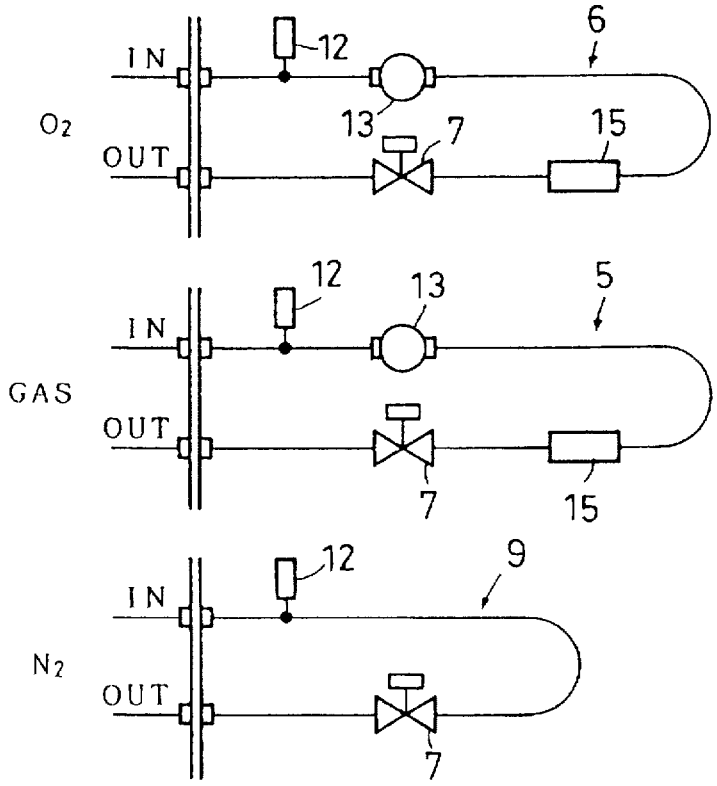
FIG. 2A is a block diagram of a gas circuit of first embodiment.

Referring first to FIG. 1, the gas flow rate controller of this embodiment has a housing 11 carrying a main control panel 10 on its front face and provided with gas inlet/outlet ports in the back. As shown in FIG. 2A, the housing 11 accommodates a gas circuit 5 for a flammable gas, a gas circuit 6 for a combustion-assisting gas, a gas circuit 9 for a fire-extinguishing noncombustible gas, and a control circuit for controlling the gas circuits 5, 6 and 9.

The gas circuits 5, 6 and 9 each comprise a pressure sensor 12, a filter 13, and a solenoid valve 7. The gas circuits 5 and 6 further include a control unit 15 for controlling the flow rate of gas. The control units 15 are controlled by the control circuit.

Figure 2B:
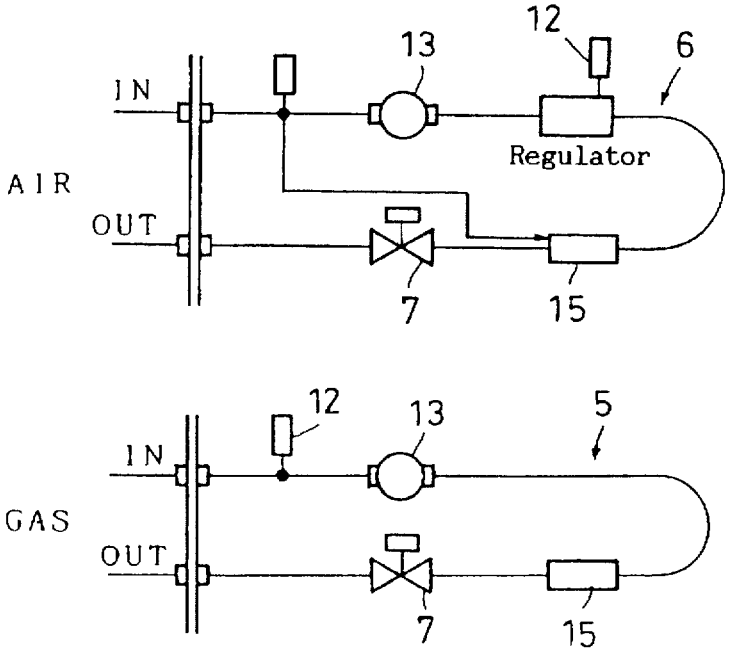
FIG. 2B is a block diagram of a gas circuit of a second embodiment.

FIG. 2B shows the structure of the gas circuits 5 and 6 when air is used as the combustion-assisting gas.

Figure 3:
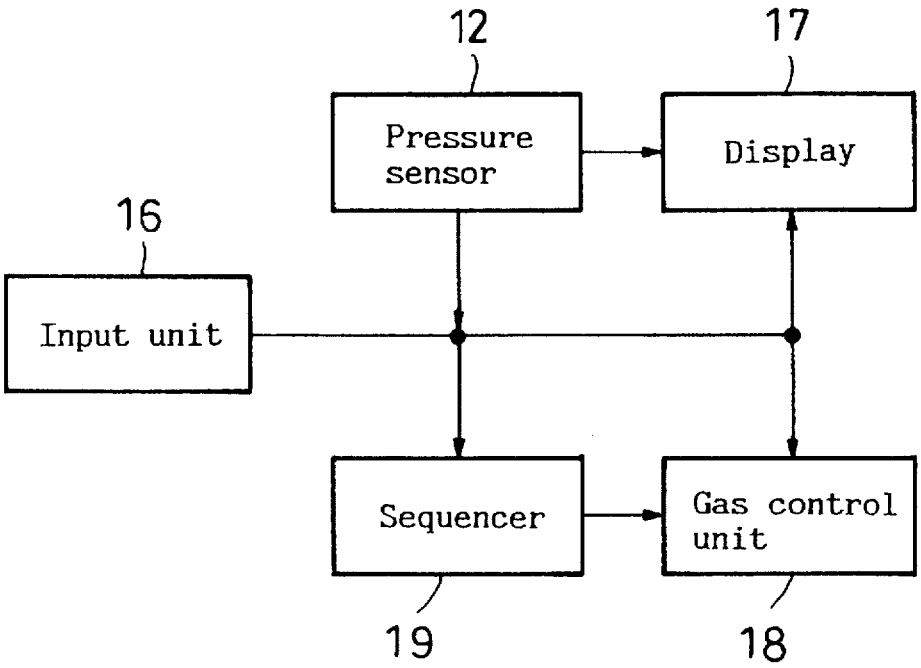
FIG. 3 is a block diagram of a control circuit of the invention.

Referring to FIG. 3, the control circuit comprises an input unit 16, a display 17, a gas control unit 18 and a sequencer 19. The sequencer 19 carries out such controls as activating and deactivating the entire device, extinguishing a fire, and adjusting the gas flow rate according to a sequence program pre-selected by controlling switches of the input unit 16. The gas control unit 18 controls the size of flames by controlling the gas flow rate.

Figure 4:
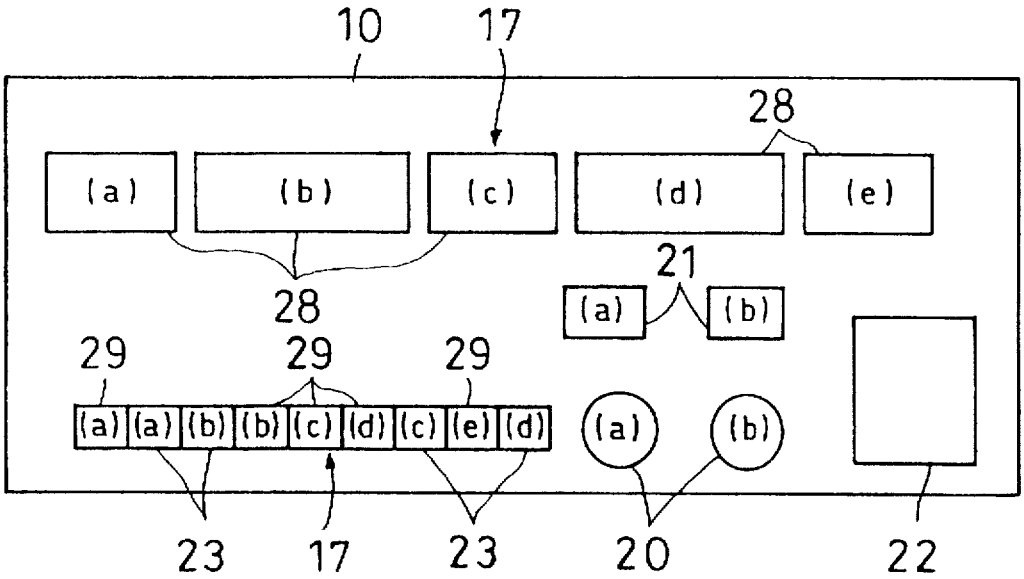
FIG. 4 is a front view of a main panel of the invention.
Figure 5:
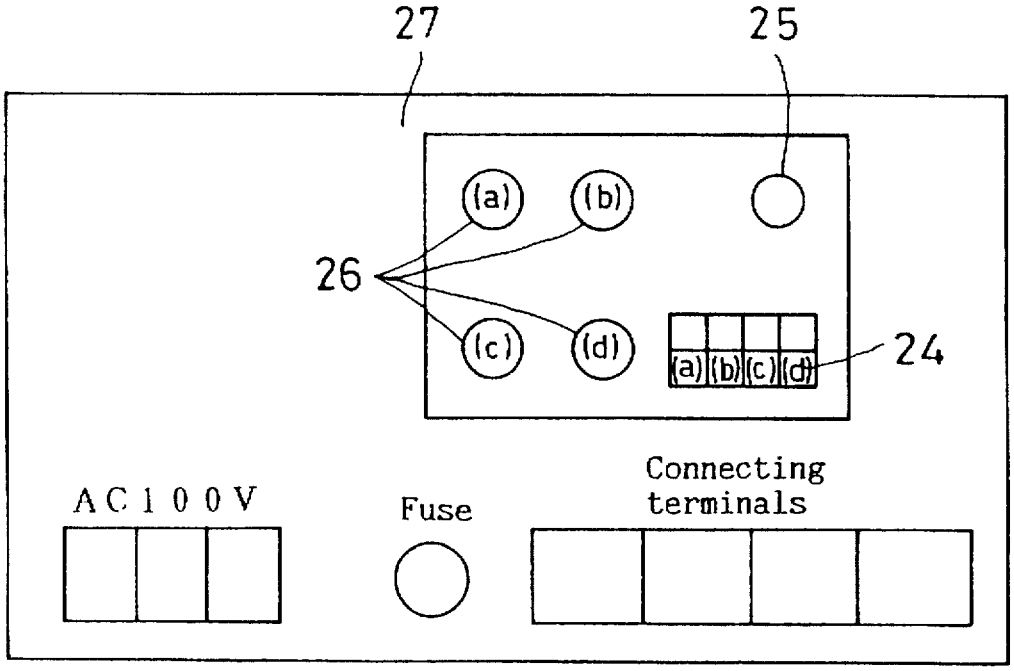
FIG. 5 is a front view of a sub-panel of the invention.

The input unit 16 comprises the main panel 10 shown in FIG. 4, and a plurality of switches 20–26 provided on a sub-panel 27 in the housing 11 as shown in FIG. 5. The respective switches 20–26 have different functions, which we will describe below.

Main panel 10 shown in FIG. 4 a) 20(*a*): weak-flame setting adjuster

By turning this adjuster while a weak-flame confirmation button 23(*a*) or a weak-flame press button 21(*a*) is ON, it is possible to adjust the flow rate of gas.

b) 20(*b*): strong-flame setting adjuster

By turning this adjuster while a strong-flame setting confirmation button 23(*b*) or a strong-flame press button 21(*b*) is ON, it is possible to adjust the flow rate of gas.

c) 21(*a*): weak-flame press button

By pressing this button 21(*a*) once, the solenoid valves 7 are turned ON, so that the gas circuits 5 and 6 open. By pressing it once again, the solenoid valves 7 are turned OFF, so that the gas circuits 5 and 6 close.

d) 21(*b*): strong-flame press button

By pressing this button 21(*b*), the gas circuits 5 and 6 open until strong flames are produced.

e) 22: strong-flame timer

This timer is activated when the strong-flame press button 21(*b*) is pressed with a select switch 23(*d*), which will be discussed later, set in an automatic mode. While the timer is ticking, the gas circuits 5, 6 are kept open, allowing the burner 1 to produce strong flames. When the timer stops, the force of flames becomes weak.

f) 23(*a*): weak-flame setting confirmation button

By pressing this button 23(*a*), a predetermined gas flow rate sufficient to produce weak flames is indicated on a combustion-assisting gas flow rate indicator 28(*b*) and a flammable gas flow rate indicator 28(*d*) of the display 17. While weak flames are being produced, the predetermined gas flow rate is displayed on the indicators 28(*b*) and 28(*d*) only while the press button 21(*a*) is pressed.

g) 23(*b*): strong-flame setting confirmation button

By pressing this button 23(*b*), a predetermined gas flow rate sufficient to produce strong flames is indicated on a combustion-assisting gas flow rate indicator 28(*b*) and a flammable gas flow rate indicator 28(*a*) of the display 17. While strong flames are being produced, the predetermined gas flow rate is displayed on the indicators 28(*b*) and 28(*d*) only while the press button 23(*b*) is pressed.

h) 23(*c*): reset button

By pressing this button, a warning lamp (which will be described later) is turned off.

i) 23(*d*): manual/automatic mode select switch

By setting the switch in the manual mode, flame strength can be manually changed over between strong and weak. In the automatic mode, the timer 22 is activated by turning ON the strong-flame press button 21(*a*).

On sub-panel shown in FIG. 5 j) 25: ratio setting adjuster

The flow rates of the combustion-assisting gas ($O_2$ or air) and the flammable gas are set by turning this adjuster.

k) 26(*a*): ramping time setting adjuster

This adjuster sets the rise time constant of the flammable gas flow rate setting signal.

l) 26(*b*): ramping time setting adjuster

This adjuster sets the rise time constant of the combustion-assisting gas ($O_2$ or air) flow rate setting signal.

m) 26(*c*): ramping time setting adjuster

This adjuster sets the fall time constant of the flammable gas flow rate setting signal.

n) 26(*d*): ramping time setting adjuster

This adjuster sets the fall time constant of the combustion-assisting gas ($O_2$ or air) flow rate setting signal.

o) 24(*a–d*): switches for actuating/resetting the ramping time setting adjusters These switches set the respective ramping time-setting adjusters.

Now, description is made of the display 17 on the main panel 10.

p) 28(*a*): combustion-assisting gas pressure indicator (primary pressure indicator)

It indicates the primary pressure (kgf/cm$^2$) of the combustion-assisting gas (oxygen or air).

q) 28(*b*): combustion-assisting flow rate indicator (flow rate indicator)

It indicates the flow rate (l/min) of the combustion-assisting gas (oxygen or air).

r) 28(*c*): flammable gas pressure indicator (secondary pressure indicator)

It indicates the primary pressure (kgf/cm$^2$) of the flammable gas.

s) 28(*d*): flammable gas flow rate indicator

It indicates the flow rate (l/min) of the flammable gas.

t) 28(*e*): non-combustible gas ($N_2$ extinguisher) pressure indicator

It indicates the primary pressure of the noncombustible gas.

u) 29(*a*): power source lamp v) 29(*b, c, d*): warning lamps

They are turned on if the pressures of the flammable gas, combustion-assisting gas, and non-combustible gas reach their lower limits.

w) 29(*e*): warning buzzer

It goes off if any one of the pressures of the flammable gas, combustion-assisting gas, and non-combustible gas reaches its lower limit.

Figure 6:
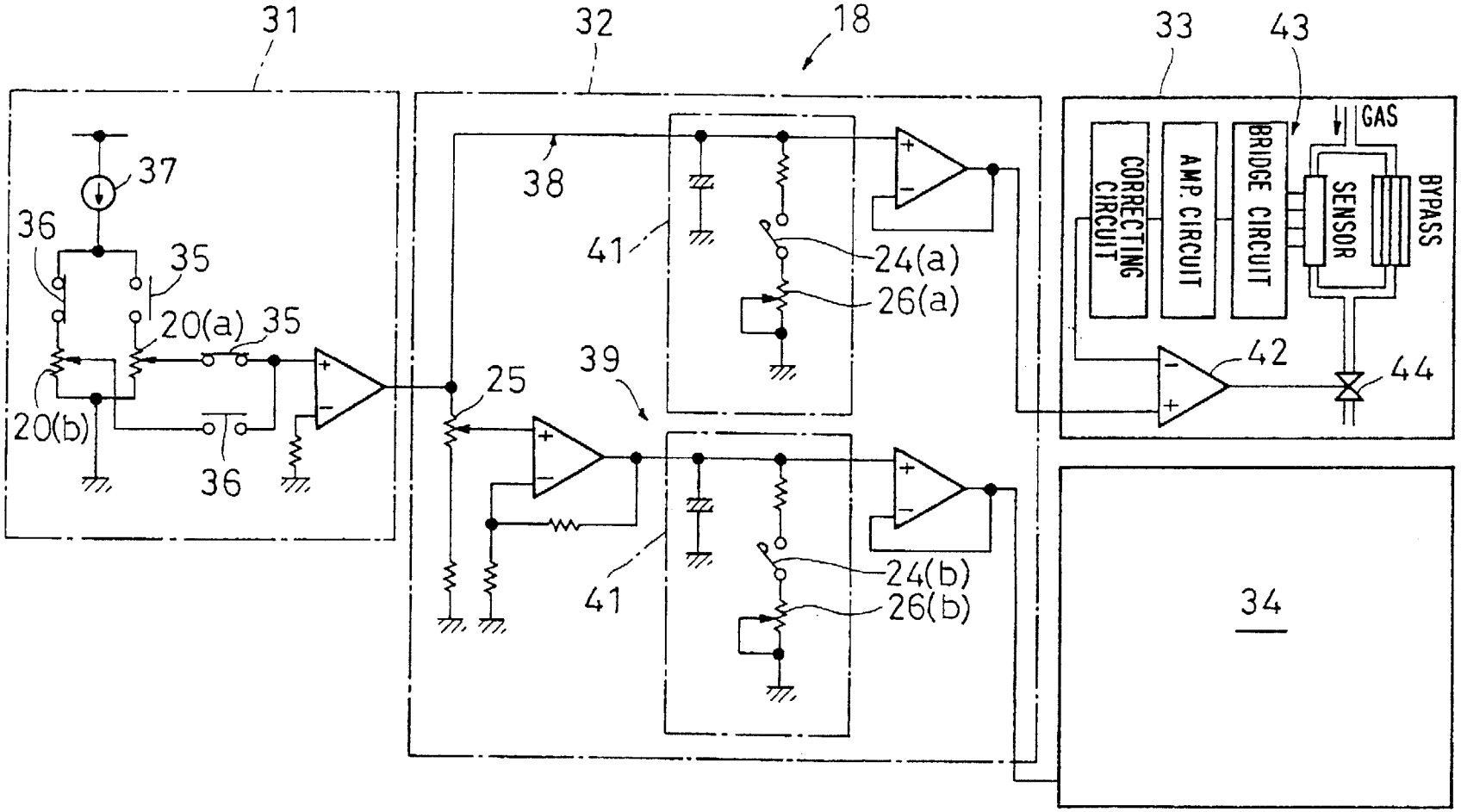
FIG. 6 is a block diagram of a gas control unit of the invention.

Now referring to FIG. 6, the gas control unit 18 comprises a flow rate setting means 31, a ratio setting means 32, and a first and second control unit 33 and 34.

The flow rate setting means 31 is a voltage generator circuit including a parallel circuit comprising two parallel-connected series circuits. One of the series circuits comprises the weak-flame setting adjuster 20(*a*) of the input unit 16 and a relay circuit 35 series-connected to the adjuster 20(*a*), and the other series circuit comprises the strong-flame setting adjuster 20(*b*) and a relay circuit 36 series-connected to the adjuster 20(*b*). The parallel circuit is series-connected to a constant-current source 37. An operational amplifier is connected through the relay circuit 36 to the outputs of the adjusters 20(*a*) and 20(*b*) of the parallel circuit. By setting the gas flow rate to the gas burner 1 with the weak-flame setting adjuster 20(*a*) and the strong-flame setting adjuster 20(*b*), a corresponding flow rate setting voltage is outputted from the operational amplifier to the ratio setting means 32. In this state, the relay circuits 35 and 36 in the flow control setting means 31 are connected to the sequencer 19. By changing over the weak-flame press button 21(*a*) and the strong-flame 21(*b*), the relay circuits 35 and 36 change over, so that the strong-flame and weak-flame modes change over.

The ratio setting means 32 of this embodiment comprises a first series circuit 38 in the form of a voltage follower circuit connected to the output of the flow rate setting means 31, and a second series circuit 39 connected through an amplifier to the ratio setting adjuster 25 and the voltage follower circuit. The voltage follower circuit forming the first series circuit 38 amplifies the flow rate setting voltage outputted by the flow rate setting means 31 by an amplification factor of one, and outputs the thus amplified voltage to the first control unit 33 as a reference signal for setting the flow rate of the flammable gas. On the other hand, the second series circuit 39 divides the flow rate setting voltage with the adjuster resistance of the ratio setting adjuster 25, amplifies the thus divided voltage, and outputs it to the second control unit 34 as a reference signal for setting the flow rate of the combustion-assisting gas. Thus, even when the flow rate setting voltage is changed by adjusting the strong-flame and weak-flame setting adjusters 20(*a*) and 20(*b*), the output voltages whose difference is kept constant can be always outputted, based on the flow rate setting voltage, from the first series circuit 38 and the second series circuit 39.

The ratio setting means 32 has a ramping circuit 41. The ramping circuit 41 comprises integrating capacitors, and time constant circuits made up of the ramping time setting adjusters 24(*a*)–(*d*) and parallel-connected to the integrating capacitors through the ramping time setting adjuster activating/resetting switches 24(*a–d*) (only 24(*a*) and 24(*b*) and 26(*a*) and 26(*b*) are shown in the figure). By controlling the ramping time setting adjusters 26(*a*)–(*d*), it is possible to adjust the rising and falling gradients of both reference voltages so that when changing the flame power between strong and weak, it can be changed not abruptly but smoothly. When changing the flame power setting, it is possible to selectively turn on or off the ramping adjustment function by controlling the ramping time setting adjuster activating/resetting switches 24(*a–d*) on the sub-panel 27.

The first control unit 33 comprises a first comparison means 42, a flow rate detecting means 43, and a control valve 44. The second control unit 34 is of the same structure. Thus, we describe only the first control unit 33, which receives the reference signal for setting the flow rate of flammable gas.

The first comparison means 42 has an input to which the flammable gas flow rate setting signal is applied, and another input to which the first flow rate detecting means 43 is applied. The comparison means compares both signals and outputs a control signal for eliminating any difference therebetween to the control valve 44.

The first flow rate detecting means 43 comprises a temperature sensor provided upstream of the first control valve 44 and its detection circuit. The temperature sensor detects the temperature difference proportional to the mass flow rate produced between the upstream and downstream sides of the sensor while the gas is flowing. After linearly correcting the thus detected signal with the detection circuit, it is outputted to the first comparison circuit.

The first control valve 44 of the embodiment is a solenoid type. Its degree of opening and thus the gas flow rate change in proportion to the control signal from the first comparison means 42.

We will now explain the operation of the device of the embodiment.

Figure 7:
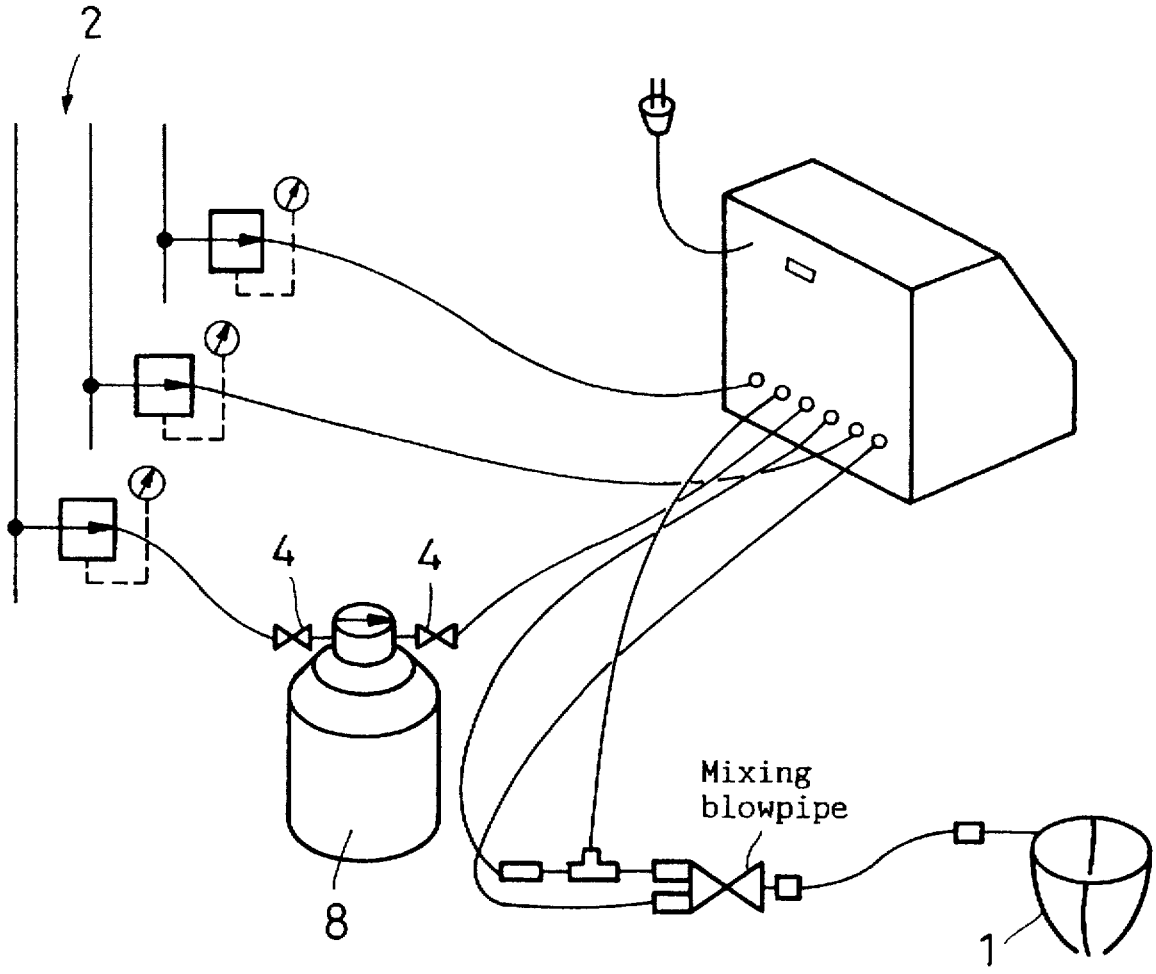
FIG. 7 is a view of the controller of the invention showing its actual state of use.
Figure 8:
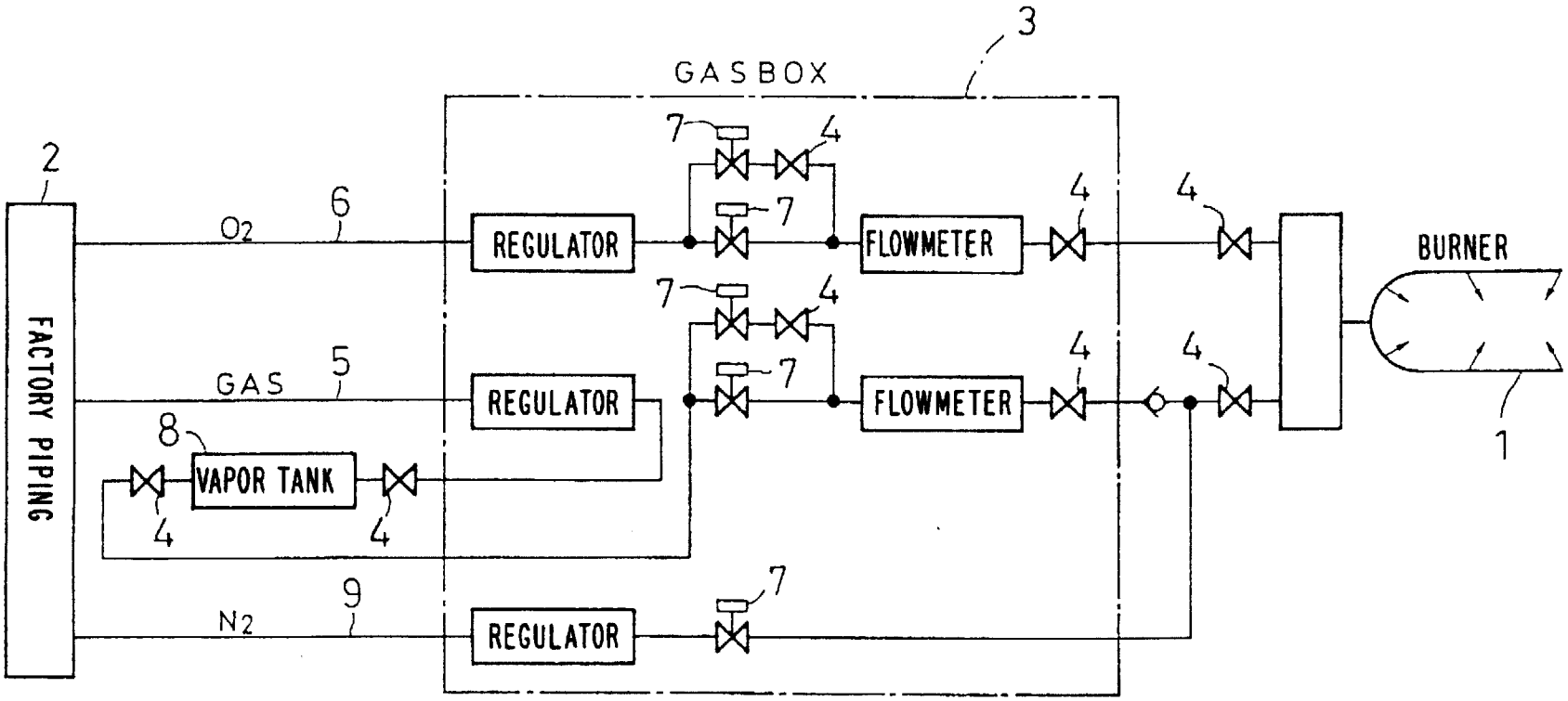
FIG. 8 PRIOR ART
FIG. 8 is a block diagram of a conventional gas flow controller.

As shown in FIG. 7, the gas flow rate controller of the embodiment is arranged in gas lines connecting gas sources 2 in a factory to e.g. a brazing gas burner 1.

Namely, gas pipes connected to flammable gas, combustion-assisting gas, and non-combustible gas sources through regulators are connected to flammable gas, combustion-assisting gas, and non-combustible gas inlets provided in the back of the housing 11. Also, gas pipes connected to the gas outlets in the back of the housing are connected to the brazing gas burner 1 through a flashback arrester and a gas mixing blowpipe.

Then, the gas flow rates when producing weak flames and strong flames are set with the weak-flame setting adjuster 20(*a*) and strong-flame setting adjuster 20(*b*) on the main panel 10.

Namely, after activating the device, confirmation is made that the displays 28(*a*) and 28(*c*) are indicating predetermined primary gas pressures of the flammable gas and combustion-assisting gas. Then, the gas flow rates for weak flames and strong flames are set by turning the weak-flame setting adjuster 20(*a*) and the strong-flame setting adjuster 20(*b*). The mixing ratio of the flammable gas and combustion-assisting gas is then set with the ratio setting adjuster 25 on the sub-panel 27 in the housing 11. In this case, after setting the actual flow rate of the flammable gas indicated on the display 28(*d*) to a rounded value with the strong-flame setting adjuster 20(*b*), the ratio setting adjuster 25 on the sub-panel 27 is controlled to adjust the mixing ratio to the value calculated from the flow rate of the combustion-assisting gas indicated on the display 28(*b*) (such a mixing ratio is e.g. a value at which the highest combustion efficiency is expected). At the same time, the time constants when the flammable gas reference signal and the combustion-assisting gas reference signals are rising and falling are determined by controlling the ramping time setting adjusters 26(*a*)–26(*d*) and the activating/resetting switches 24(*a*)–24(*d*) for the ramping time setting adjusters.

After such initial setting, the weak-flame press button 21(*a*) and the strong-flame press button 21(*b*) on the main panel 10 are pressed to activate e.g. the weak-flame setting adjuster 20(*a*). When the adjuster 20(*a*) is activated, the gas flows at a rate sufficient to produce weak flames to the burner 1. By changing over the weak-flame press button 21(*a*) and the strong-flame press button 21(*b*) in this state, the relay circuits 35 and 36 in the flow rate setting means change over, so that the weak-flame setting adjuster 20(*a*) and the strong-flame setting adjuster 20(*b*) change over. Flame strength thus changes over between weak and strong.

Even though the flow rate setting voltage varies by adjusting the weak-flame setting adjuster 20(*a*) and the strong-flame setting voltage 20(*b*), the difference between the flammable gas setting reference voltage and the combustion-assisting gas setting reference voltage which are outputted from the ratio setting means 32 and inputted in the comparison means 42 in the first control unit 33 and the second control unit 34, respectively, is kept at a constant rate. These reference voltages are compared with the actual flow rates of the flammable gas and the combustion-assisting gas, which are detected by the flow rate detecting means 43, and the control valve 44 is controlled to eliminate any difference between the reference voltages and the actual gas flow rates. Since the gas flow rates are thus kept at predetermined values, the gas mixing ratio is maintained at an optimum value even when the weak-flame setting adjuster 20(*a*) and/or the strong-flame setting adjuster 20(*b*) is turned.

According to the gas flow rate controller of this invention, the ratio setting means 32 produces the flammable gas setting reference signal and the combustion-assisting gas reference signal at a predetermined ratio, based on the gas flow rate setting signal produced by the gas flow rate setting means 31. The control units 33, 34 adjust the actual gas flow rates based on these reference signals. Thus, even if the primary gas pressure varies due to changes in the external temperature, the amount of gas used, the amount of gas remaining, etc., the gas mixing ratio will remain constant.

When the flame strength is changed from strong to weak or from weak to strong, the gas mixing ratio is kept at the optimum value.

Thus, the flame power can be controlled with the single dial of the gas flow rate setting means.

Namely, by using the controller according to the invention in place of a conventional gas box for brazing, welding or glass working, it is possible to control the gas flow rate without depending upon the sixth sense of an experienced operator.

Heating can be carried out economically because the gas mixing ratio can be held constant without the need to adjust valves every time the gas pressure changes.

Moreover, even an inexperienced operator can easily maintain flames at a predetermined level, so that it is possible to reduce the defective rate and to resolve the problem of shortage of experienced operators. Brazing can be carried out with high accuracy.

What is claimed is:

1. A gas flow rate controller for use in controlling a flow rate of a first gas and a flow rate of a second gas, said gas flow rate controller comprising:

an electronic gas flow rate setting means for electronically setting a desired flow rate of the first gas;

an electronic ratio setting means for electronically setting a ratio between the flow rate of the first gas and the flow rate of the second gas a first control valve for controlling the flow rate of the first gas;

a second control valve for controlling the flow rate of the second gas; and an electronic valve control means for electronically controlling said first control valve to discharge the first gas at the desired flow rate set by said gas flow rate setting means even if a gas pressure at which the first gas is supplied to said first control valve changes, and for electronically controlling said second control valve to discharge the second gas at the flow rate determined based on the desired flow rate set by said gas flow rate setting means and the ratio set by said ratio setting means even if a pressure at which the second gas is supplied to said second control valve changes.

2. A gas flow rate controller for use in controlling a flow rate of a flammable gas and a flow rate of a combustion-assisting gas to a gas burner, said gas flow rate controller comprising:

a flammable gas flow rate setting means for setting a desired flow rate of the flammable gas flowing toward the gas burner and producing a flammable gas flow rate setting signal corresponding to the desired flow rate of the flammable gas;

a ratio setting means for producing a combustion-assisting gas flow rate setting signal at a predetermined ratio based on said flammable gas flow rate setting signal produced by said flammable gas flow rate setting means;

a first flow rate detecting means for detecting an actual flow rate of the flammable gas as it flows toward the gas burner;

a second flow rate detecting means for detecting an actual flow rate of the combustion-assisting gas as it flows toward the gas burner;

a first comparison means for comparing the actual flow rate of the flammable gas detected by said first flow rate detecting means with said flammable gas flow rate setting signal produced by said flammable gas flow rate setting means to produce a control signal for eliminating any difference therebetween;

a second comparison means for comparing the actual flow rate of the combustion-assisting gas detected by said second flow rate detecting means with said combustion-assisting gas flow rate setting signal produced by said ratio setting means to produce a control signal for eliminating any difference therebetween;

a first control valve for controlling the flow rate of the flammable gas as it flows toward the gas burner based on said control signal produced by said first comparison means; and a second control valve for controlling the flow rate of the combustion-assisting gas as it flows toward the gas burner based on said control signal produced by said second comparison means.

3. A gas flow rate controller as claimed in claim 2, wherein said flammable gas flow rate setting means includes a first setting switch for setting a first flow rate of the flammable gas, and a second setting switch for setting a second flow rate of the flammable gas which is lower than said first flow rate.

4. A gas flow rate controller as claimed in claim 3, wherein, when the flow rate of the flammable gas as set by said flammable gas flow rate setting means and the flow rate of the combustion-assisting gas as determined by said ratio setting means change by operating one of said first and second setting switches, said controller controls said first control valve and said second control valve so that the flow rates of the flammable gas and the combustion-assisting gas change gradually to flow rates set by said one of said first and second setting switches.

5. A gas flow rate controller as claimed in claim 3, wherein said ratio setting means includes a variable adjuster for adjusting the ratio to any desired value.

6. A gas flow rate controller as claimed in claim 3, wherein:

when the flow rate of the flammable gas set by said flammable gas flow rate setting means changes by operating said first setting switch, said controller controls said first control valve so that the flow rate of the flammable gas changes gradually to said first flow rate and controls said second control valve so that the flow rate of the combustion-assisting gas changes gradually to a flow rate determined based on said first flow rate and said ratio; and when the flow rate of the flammable gas set by said flammable gas flow rate setting means changes by operating said second switch, said controller controls said first control valve so that the f low rate of the flammable gas changes gradually to said second flow rate and controls said second control valve so that the flow rate of the combustion-assisting gas changes to a flow rate based on said second flow rate and said ratio.

7. A burner heating device for use in producing a gas mixture by mixing a flammable gas and a combustion-assisting gas in a gas mixing chamber, feeding the gas mixture into a burner, and igniting the gas mixture fed into the burner to heat an article in the burner, said burner heating device comprising:

an electronic flow rate setting means for electronically setting a desired flow rate of the gas mixture;

an electronic gas mixture ratio setting means for electronically setting a mixture ratio of the flammable gas and the combustion-assisting gas fed into the gas mixing chamber;

a flammable gas flow rate control means for controlling the flow rate of the flammable gas as it is fed into the gas mixing chamber;

a combustion-assisting gas flow rate control means for controlling the flow rate of the combustion-assisting gas as it is fed into the gas mixing chamber; and an electronic control means for electronically controlling said flammable gas flow rate control means so that the flammable gas will be fed into the gas mixing chamber at the desired flow rate set by said flow rate setting means even if a gas pressure at which the flammable fas is supplied to said flammable gas flow rate control means changes, and for electronically controlling said combustion-assisting gas flow rate control means so that the combustion-assisting gas will be fed into the gas mixing chamber at the flow rate determined based on the flow rate set by said flow rate setting means and the gas mixture ratio set by said gas mixture ratio setting means even if a gas pressure at which the combustion-assisting gas is supplied to said combustion-assisting gas flow rate control means changes.

8. A burner heating device as claimed in claim 7, wherein said gas mixture ratio setting means includes a variable adjuster for setting the mixture ratio to any desired value.

9. A burner heating device as claimed in claim 7, wherein said flow rate setting means includes a first setting switch for setting a first flow rate of the flammable gas, and a second setting switch for setting a second flow rate of the flammable gas which is lower than said first flow rate.

10. A burner heating device as claimed in claim 9, wherein:

when the flow rate of the flammable gas set by said flow rate setting means changes upon operation of said first setting switch, said control means controls said flammable gas flow rate control means so that the flow rate of the flammable gas changes gradually to said first flow rate and controls said combustion-assisting gas flow rate control means so that the flow rate of the combustion-assisting gas changes gradually to a flow rate determined based on said first flow rate and said ratio; and when the flow rate of the flammable gas set by said flow rate setting means changes by operating said second switch, said control means controls said flammable gas flow rate control means so that the flow rate of the flammable gas changes gradually to said second flow rate and controls said combustion-assisting gas flow rate control means so that the flow rate of the combustion-assisting gas changes to a flow rate based on said second flow rate and said ratio.

11. A burner heating device as claimed in claim 9, wherein, when the flow rate of the flammable gas as set by said flow rate setting means and the flow rate of the combustion-assisting gas as determined by said ratio setting means are changed upon operation of said first or second setting switch, said control means controls said flammable gas flow rate control means and said combustion-assisting gas flow rate control means so that the flow rates of the flammable gas and the combustion-assisting gas change gradually to flow rates set by said first or second setting switches.

12. A burner heating device for use in producing a gas mixture by mixing a flammable gas and a combustion-assisting gas in a gas mixing chamber, feeding the gas mixture into a burner, and igniting the gas mixture fed into the burner to heat an article in the burner, said burner heating device comprising:

a flow rate setting means for setting a desired flow rate of the gas mixture;

a gas mixture ratio setting means for setting a gas mixture ratio of the flammable gas and the combustion-assisting gas fed into the gas mixing chamber;

a flammable gas flow rate control means for controlling the flow rate of the flammable gas as it is fed into the gas mixing chamber;

a combustion-assisting gas flow rate control means for controlling the flow rate of the combustion-assisting gas as it is fed into the gas mixing chamber;

a control means for controlling said flammable gas flow rate control means so that the flammable gas will be fed into the gas mixing chamber at the desired flow rate set by said flow rate setting means and controlling said combustion-assisting gas flow rate control means so that the combustion-assisting gas will be fed into the gas mixing chamber at the flow rate determined based on the desired flow rate set by said flow rate setting means and the gas mixture ratio set by said gas mixture ratio setting means;

wherein said flow rate setting means includes a first setting switch for setting a first flow rate of the flammable gas, and a second setting switch for setting a second flow rate of the flammable gas which is lower than said first flow rate; and wherein, when the desired flow rate of the flammable gas as set by said flow rate setting means and the flow rate of the combustion-assisting gas as determined by said ratio setting means are changed upon operation of said first or second setting switch, said control means controls said flammable gas flow rate control means and said combustion-assisting gas flow rate control means so that the flow rates of the flammable gas and the combustion-assisting gas change gradually to flow rates set by said first or second setting switches.

13. A gas flow rate controller for use in controlling a flow rate of a first gas and a flow rate of a second gas, said gas flow rate controller comprising:

a flow rate setting means for setting a first set flow rate;

a ratio setting means for setting a ratio of the flow rate of the second gas with respect to the flow rate of the first gas and setting a second set flow rate based on said ratio;

a first valve for controlling the flow rate of the first gas;

a second valve for controlling the flow rate of the second gas;

a first control unit for sensing an actual flow rate of the first gas, for comparing the actual flow rate of the first gas with said first set flow rate and for controlling said first valve so as to eliminate any difference between the actual flow rate of the first gas and said first set flow rate; and a second control unit for sensing an actual flow rate of the second gas, for comparing the actual flow rate of the second gas with said second set flow rate, and for controlling said second valve so as to eliminate any difference between the actual flow rate of the second gas and said second set flow rate.

14. A gas flow rate controller as claimed in claim 13 wherein:

said flow rate setting means is operable to generate a first set flow rate signal representing said first set flow rate;

said ratio setting means is operable to generate a second set flow rate signal representing said second set flow rate;

said first control unit comprises, a first sensing means for generating a first sensing signal representing the actual flow rate of the first gas, a first comparison means for comparing said first set flow rate signal and said first sensing signal and generating a first control signal representing the difference between said first set flow rate signal and said first sensing signal, and a first valve control means for controlling said first valve so as to eliminate any difference represented by said first control signal; and said second control unit comprises, a second sensing means for generating a second sensing signal representing the actual flow rate of the second gas, a second comparison means for comparing said second set flow rate signal and said second sensing signal and generating a second control signal representing the difference between said second set flow rate signal and said second sensing signal, and a second valve control means for controlling said second valve so as to eliminate any difference represented by said second control signal.

15. A flow rate controller as claimed in claim 14 wherein said first sensing means comprises a first temperature sensor for detecting a temperature difference proportional to the flow rate produced between an upstream side and a downstream side of said first temperature sensor and wherein said second sensing means comprises a second temperature sensor for detecting a temperature difference between an upstream side and a downstream side of said second temperature sensor.

16. A flow rate controller as claimed in claim 13 wherein said flow rate setting means comprises a first setting switch for setting said first set flow rate as a strong set flow rate and a second setting switch for setting said first set flow rate as a weak set flow rate which is lower than said strong set flow rate.

17. A flow rate controller as claimed in claim 16 further comprising ramping means for gradually changing the flow rate of the first gas and the flow rate of the second gas when said first set flow rate is changed by either of said first setting switch or said second setting switch.

18. A flow rate controller as claimed in claim 17 wherein said ramping means gradually changes said first set flow rate from said weak set flow rate to said strong set flow rate when said first setting switch is activated, and gradually changes said first set flow rate from said strong set flow rate to said weak set flow rate when said second setting switch is activated.

19. A flow rate controller as claimed in claim 17 wherein said ramping means further comprises ramping time adjusting means for adjusting the amount of time required for said ramping means to change said first set flow rate from said strong set flow rate to said weak set flow rate, and for adjusting the amount of time required for said ramping means to change said first set flow rate from said weak set flow rate to said strong set flow rate.

20. A flow rate controller as claimed in claim 18 wherein said ramping means gradually changes said second set flow rate from a flow rate based on said weak set flow rate and said ratio to a flow rate based on said strong set flow rate and said ratio when said first setting switch is activated, and gradually changes said second set flow rate from a flow rate based on said strong set flow rate and said ratio to a flow rate based on said weak set flow rate and said ratio when said second setting switch is activated.

21. A flow rate controller as claimed in claim 20 wherein said ramping means further comprises ramping time adjusting means for adjusting the amount of time required for said ramping means to change said second set flow rate from a flow rate based on said strong set flow rate to a flow rate based on said weak set flow rate, and for adjusting the amount of time required for said ramping means to change said second set flow rate from a flow rate based on said weak set flow rate to a flow rate based on said strong set flow rate.

22. A flow rate controller as claimed in claim 16 wherein said flow rate setting means further comprises a strong flame adjuster for adjusting the value of said strong set flow rate and a weak flame adjuster for adjusting the value of said weak set flow rate.

23. A flow rate controller as claimed in claim 13 wherein said ratio setting means comprises a variable adjuster for adjusting said ratio to any desired value.

* * * * *